United States Patent [19]

Stonebraker et al.

[11] Patent Number: 5,066,182

[45] Date of Patent: Nov. 19, 1991

[54] APPARATUS AND METHOD FOR ASSEMBLING A COVER CASE AND BINDER

[75] Inventors: Richard L. Stonebraker; James Lasley, both of Crawfordville, Ind.

[73] Assignee: R. R. Donnelley & Sons Company, Chicago, Ill.

[21] Appl. No.: 575,218

[22] Filed: Aug. 30, 1991

[51] Int. Cl.[5] ..... B42C 7/00

[52] U.S. Cl. ..... 412/3; 412/17; 281/21.1; 281/36

[58] Field of Search ..... 412/3, 9, 11, 17, 33, 412/34; 281/21.1, 36

[56] References Cited

U.S. PATENT DOCUMENTS 3,314,089 4/1967 Margolis et al. ..... 412/3

FOREIGN PATENT DOCUMENTS 2619053 2/1989 France ..... 412/34

2145033 3/1985 United Kingdom ..... 412/34

OTHER PUBLICATIONS

Xerox mail adv.; "Xerox Demand Book Binding System"; publication date unknown.

*Primary Examiner*—Hien H. Phan

*Assistant Examiner*—Raymond D. Woods

*Attorney, Agent, or Firm*—Arnold, White & Durkee

[57] ABSTRACT

An apparatus for assembling a cover case and a channel binder includes a hopper containing several cover cases. An applicator for applying adhesive on cover cases is positioned adjacent the hopper. A channel placer is adjacent the adhesive applicator. A pusher assembly moves cover cases from the hopper and through the applicator where adhesive is applied to the back of each cover case. Once adhesive has been applied to the back of the cover case, the pusher assembly moves the cover case to the channel placer. In the channel placer, a channel is removed from a channel cartridge and placed on the adhesive on the back of the cover case. Portions of the cover case with adhesive are then pressed to the bottom and sides of the channel, and the cover case with channel is moved to a storage hopper or to a station for securing an end sheet to the inside of the cover case.

13 Claims, 7 Drawing Sheets

APPARATUS AND METHOD FOR ASSEMBLING A COVER CASE AND BINDER

FIELD OF THE INVENTION

The present invention relates to a new and improved apparatus for assembling a hard or soft cover case and a channel binder, and to a new and improved method for assembling a hard or soft cover case and a channel binder.

DESCRIPTION OF THE PRIOR ART

There are many ways to bind pages and hard or soft cover cases together to form books, magazines, pamphlets and other types of printed material. One common method of binding is to use an adhesive to secure pages to a cover. This form of binding is preferred for those situations where the user does not wish to customize the particular book, magazine or pamphlet. If, however, a user wishes to produce a small number of books, magazines, pamphlets and the like by hand, as for example, a user who makes a variety of presentations and the number of pages and the specific contents of the presentation booklets vary from one presentation to the other as in demand printing, the user prefers to do this quickly and easily. Demand printing is difficult using adhesive binding techniques since the preparation of adhesives for binding pages to a cover case is typically too difficult for the ordinary user for a small number of books. It is desirable that a pre-assembled cover case and binding structure be available of ruse to assemble customized books, magazines, pamphlets and the like in demand printing type situations.

SUMMARY OF THE INVENTION

Briefly, the present invention is directed to a new and improved apparatus for assembling a hard or soft cover case and a page binder. The assembled cover case and binder are easily used to bind a selected number of pages.

The apparatus of the present invention includes a hopper that is loaded with a plurality of cover cases. To assemble the cover cases to the page binders, a pusher is activated to remove the bottom cover case from the hopper and drive the case through an adhesive applicator. A sensor detects the cover case and actuates the adhesive applicator at the appropriate time to apply adhesive, such as hot melt glue, to the back or joint of the cover case. At the completion of the application of adhesive, a second set of pushers moves the cover case into a channel placer. The channel placer includes a channel cartridge that is loaded with a plurality of channels. The channels are removed from the cartridge and placed onto each cover case by a channel die. The first step in placing a channel is to pivot the channel die from a standby position to a position adjacent the channel cartridge. A channel feeder is then activated to push a channel out of the channel cartridge onto the channel die. The channel die is returned to its original position and then moved toward the back of the cover case to press the channel against the cover case and onto the adhesive. At the same time, side clamps are pushed by air cylinders to press portions of the back of the cover case against the sides of the channel. The channel die and side clamps are then retracted, and another set of pushers drives the cover case with the channel out of the channel placer and onto a conveyor. From there the cover case is conveyed to an end sheet applicator where adhesive is applied to the end sheet and the end sheet is secured to the inside cover. The end sheet is then slit at a location above the channel along the full length of the channel.

BRIEF DESCRIPTION OF THE DRAWINGS

Other objects and advantages of the invention will become apparent upon reading the following detailed description and upon reference to the drawings in which.

DETAILED DESCRIPTION OF PREFERRED EMBODIMENT

The method and apparatus of the present invention are used to assemble a hard or soft cover case generally designated by the reference number 10 (FIGS. 1–4) that consists of a first or front cover 12 and a second or back cover 14. The front cover 12 is interconnected to the back cover 14 by a flexible cover case back or joint 16.

Figure 1:
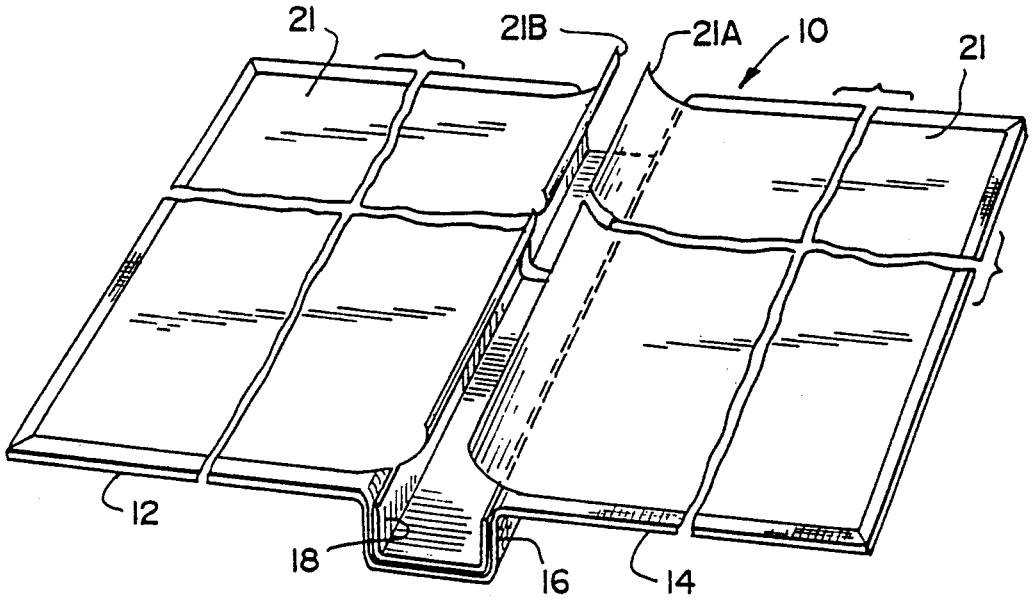
FIG. 1 is a perspective view of a finished cover case assembled in accordance with the principles of the present invention.
Figure 2:
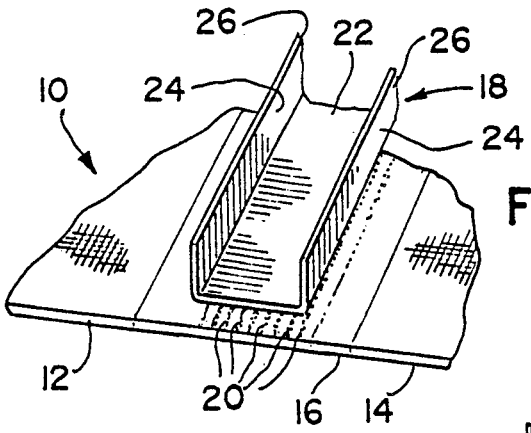
FIG. 2 is a perspective view illustrating the positioning of a channel over a cover case prior to pressing the channel onto adhesive on the cover case.
Figure 3:
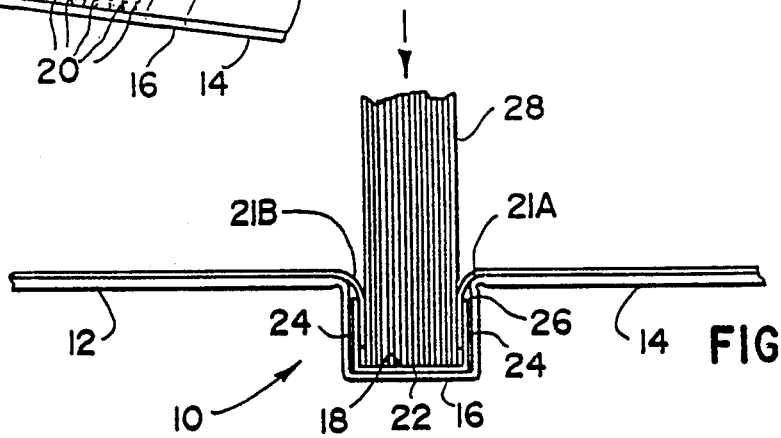
FIG. 3 is an end view of a finished cover case and channel with pages inserted into the channel prior to binding.
Figure 4:
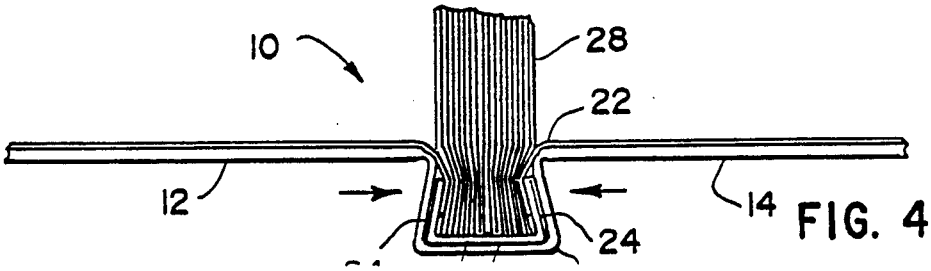
FIG. 4 is a view similar to FIG. 3 illustrating the clamping of the channel to bind the pages in the cover case.
Figure 6:
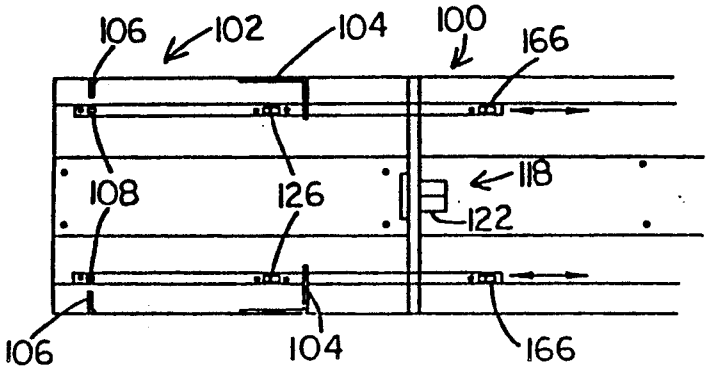
FIG. 6 is a top plan view of a portion of the cover case feed mechanism illustrated in FIG. 5.
Figure 5:
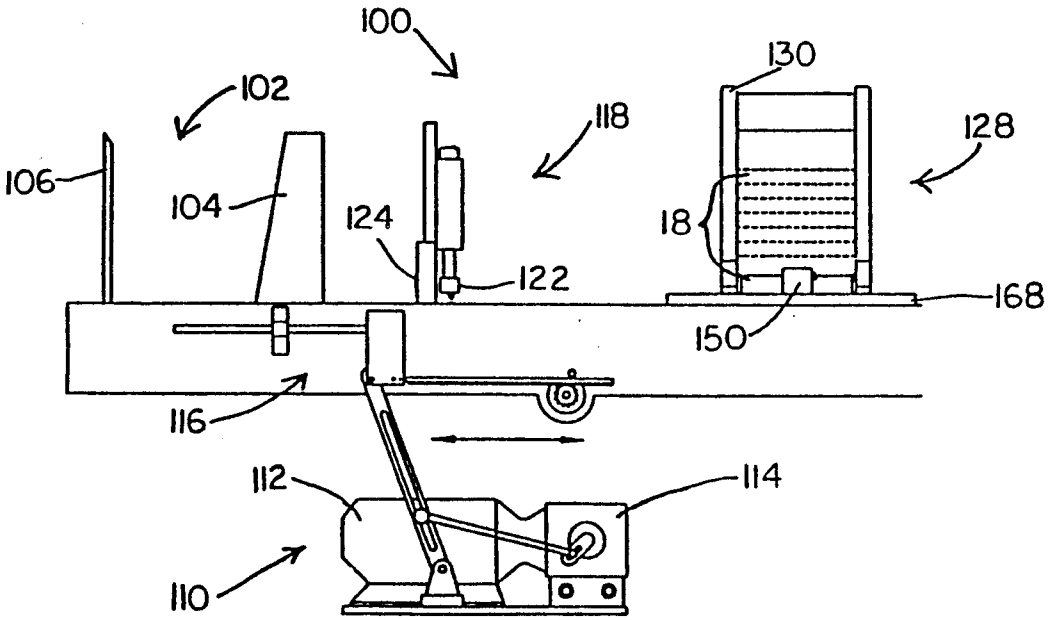
FIG. 5 is a reduced side elevational view of a cover case feeding mechanism.
Figure 11:
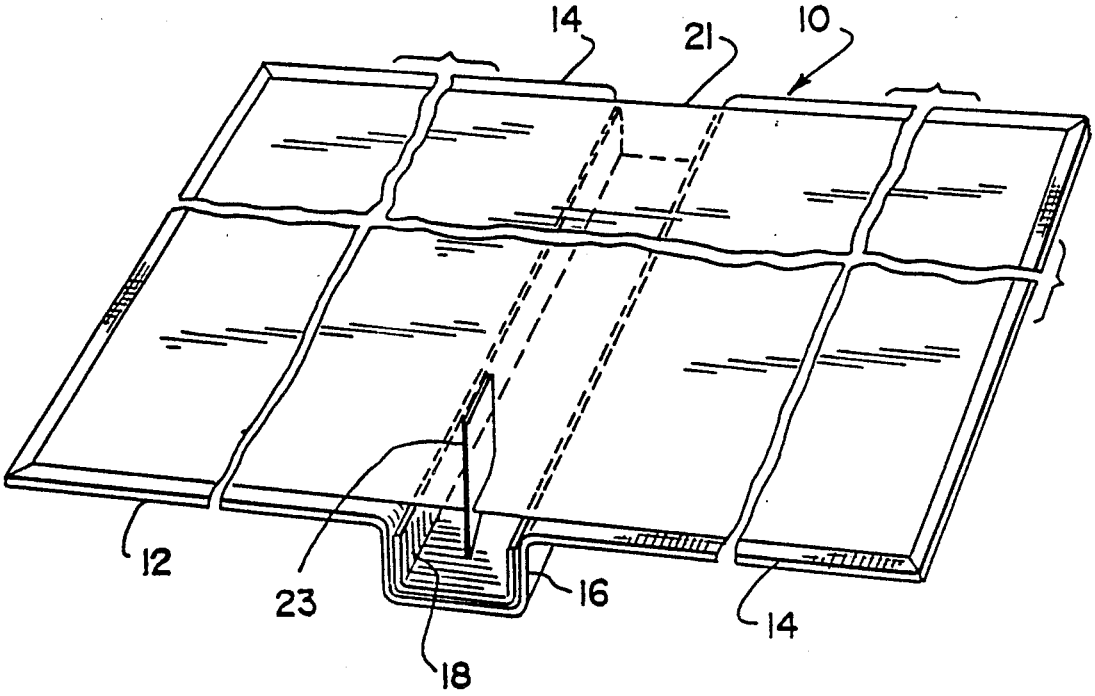
FIG. 11 is a perspective view of a cover case and channel with an end sheet and the instrument for slitting the end sheet above the channel.

Using the apparatus and the method of the present invention, a channel 18 of metal such as steel or other deformable material is pressed onto adhesive 20 applied to the cover case back 16. The adhesive 20 is a hot melt adhesive such as Swift 82-407 hot melt. The bottom 22 and the sides 24 of the deformable channel 18 are secured by the adhesive 20 to the cover case back 16 in a location where upper edges 26 of the channel 18 are located slightly below a plane defined by the front cover 12 and the back cover 14 (FIG. 3). To provide a finished appearance and a guide for insertion of loose pages, an end sheet 21 is secured to the inside of the front cover 12 and the back cover 14 by an animal glue such as Beckton animal glue. The end sheet 21 is then slit by a knife 23 across its width above the channel 18 leaving ends 21A and 21B (FIG. 11). The ends 21A and 21B of the end sheet 21 extend over the upper edges of the channel 18 and serve to guide a plurality of pages 28 into the channel 18.

A cover case 10 with a deformable channel 18 in the position illustrated in FIG. 3 is ready for binding the pages 28. As the pages 28 are dropped into the deformable channel 18 as illustrated in FIG. 3, the ends 21A and 21B of the end sheet 21 guide the pages 28 over the upper edges 26 of the channel 18 without catching on the edges 26. Once the pages 28 are completely in the channel 18, a clamping force is applied to the sides 24 of the channel 18 as indicated by the arrows adjacent the channel 18 in FIG. 4. This clamping force deforms the channel 18 and clamps the sides 24 of the channel 18 onto the pages 28 binding the pages 28 in the cover case 10. The edges 21A and 21B of the end sheet 21 adjacent the cover case back or joint 16 are held by the deformed sides 24 of the channel 18 providing a finished appearance to the cover case 10 and bound pages 28. Crimping or bending of the metal channel 18 is preferably accomplished using a mechanical binder in a Xerox Demand Book Binding System provided by Demand Book Binding Systems, Inc. of Rochester, New York.

The cover case 10 constructed in accordance with the principles of the present invention provides a bound book, pamphlet or magazine that can be customized to a particular need. The binding of pages in the cover case is done quickly and easily.

The apparatus and process for assembling the cover case 10 are illustrated in FIGS. 5–10. A cover case 10 and a channel 18 are assembled by an apparatus generally designated by the reference numeral 100. The assembly apparatus 100 includes a hopper 102 into which cover cases 10 are loaded. The cover cases 10 are maintained in position by front guides 104 and rear guides 106. To commence the assembly process a first set of spring loaded pushers 108 are moved forward by a drive rotor assembly 110. The drive rotor assembly 110 includes a drive rotor 112 and a drive mechanism 114. The drive rotor 112 and drive mechanism 114 are connected to the first set of pushers 108 by an arm assembly generally designated by the reference number 116. The first set of pushers 108 upon being moved forward, remove a bottom cover case 10 from a stack of cover cases in the hopper 102 and drive the cover case 10 toward an adhesive application assembly generally designated by reference number 118. The adhesive application system may be of the type provided by Valco of Cincinnati, Ohio.

The adhesive application assembly 118 supplies adhesive to an adhesive application 122. In a preferred embodiment of the invention, the adhesive is hot melt glue. As a cover case 10 is moved towards the adhesive applicator 122, an electric eye or similar sensor 124 detects the leading edge of the moving cover case 10 and actuates the adhesive applicator 122 to commence the application of adhesive 20 on the cover case back or joint 16. As the trailing edge of the cover case 10 passes the sensor 124, the adhesive applicator 122 is turned off.

Once the adhesive 20 is applied to the cover case back or joint 16, a second set of pushers 126 driven by the drive rotor assembly 110 moves the cover case 10 into a channel placer generally designated by the reference number 128. The channel placer 128 functions to place a deformable channel 18 onto the cover case 10 at the back or joint 16. Individual channels 18 are stored in a channel cartridge 130, and are deposited in the channel cartridge 130 by a channel feed conveyor 132.

The second set of pushers 126 move the cover case with the adhesive 20 into the channel placer 128 to a location below a channel die 134. In this location the cover case 10 is on work surface 136. The work surface 136 has a gap or opening 138 below which is located a spring loaded backbone plate 140. The cover case back or joint 16 is located above or on the spring loaded backbone plate 140. To place a channel 18 on the cover case back or joint 16, the channel die 134 is pivoted 90° about the pivot point 142 by an air cylinder 144 that includes a rod 146 pivotally mounted at a pivot point 148 on the channel die 134. Upon extension of the air cylinder rod 146, the channel die 134 is pivoted 90° about the pivot point 142 to the channel pick-up position illustrated in FIG. 8. Channels 18 are moved onto the channel die 134 int he channel pick-up position by a channel feed air cylinder 150 that includes a feed rod 152 with a pusher member 154. Upon energization of the channel feed air cylinder 150, the feed rod 152 is extended and the pusher member 154 engages a channel 18 in the bottom of the channel cartridge 130 and moves that channel 18 onto the channel die 134. The channel 18 is held by friction on the channel die 134.

Figure 7:
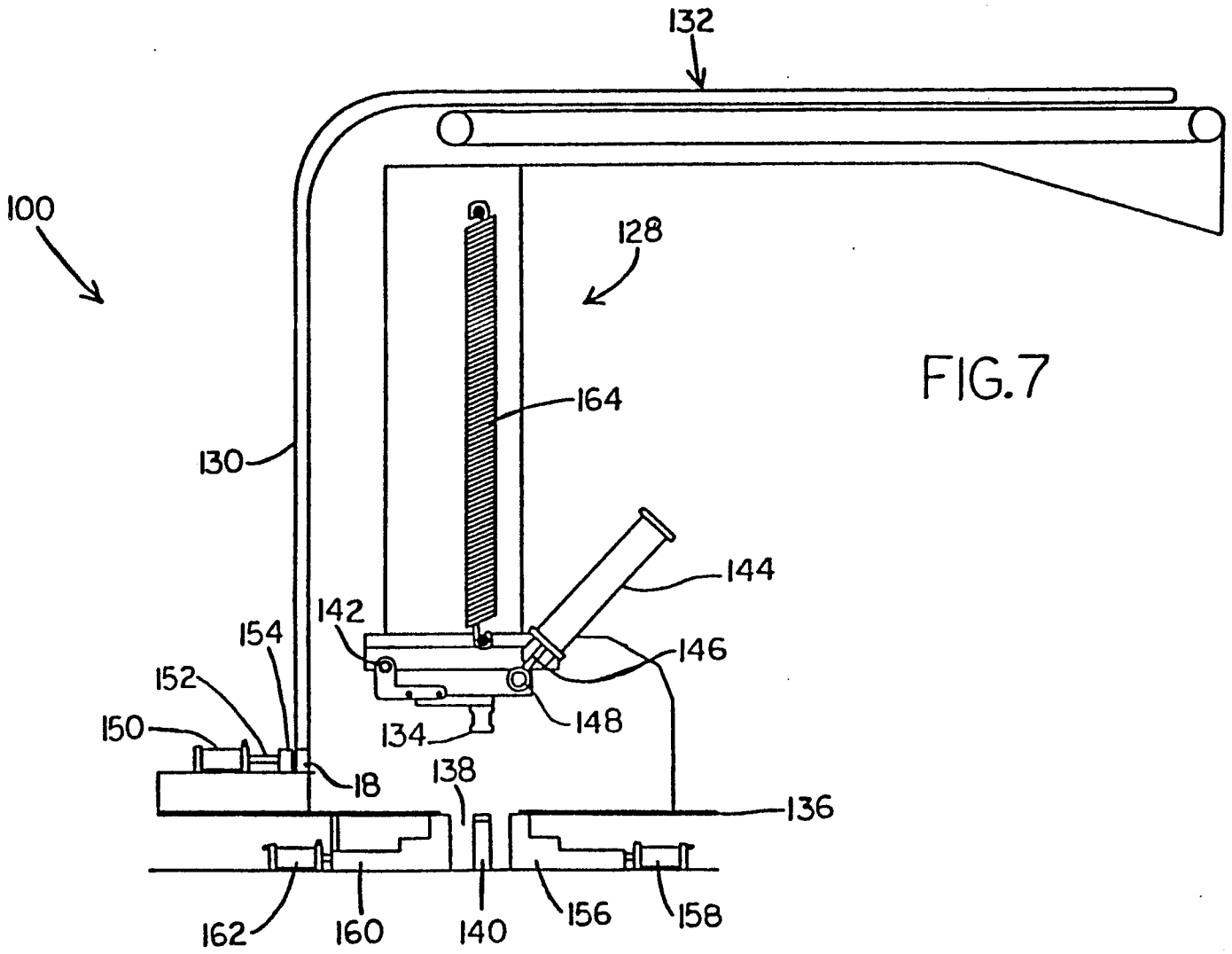
FIG. 7 is an enlarged side elevational view of a channel placer in a stand-by mode.
Figure 8:
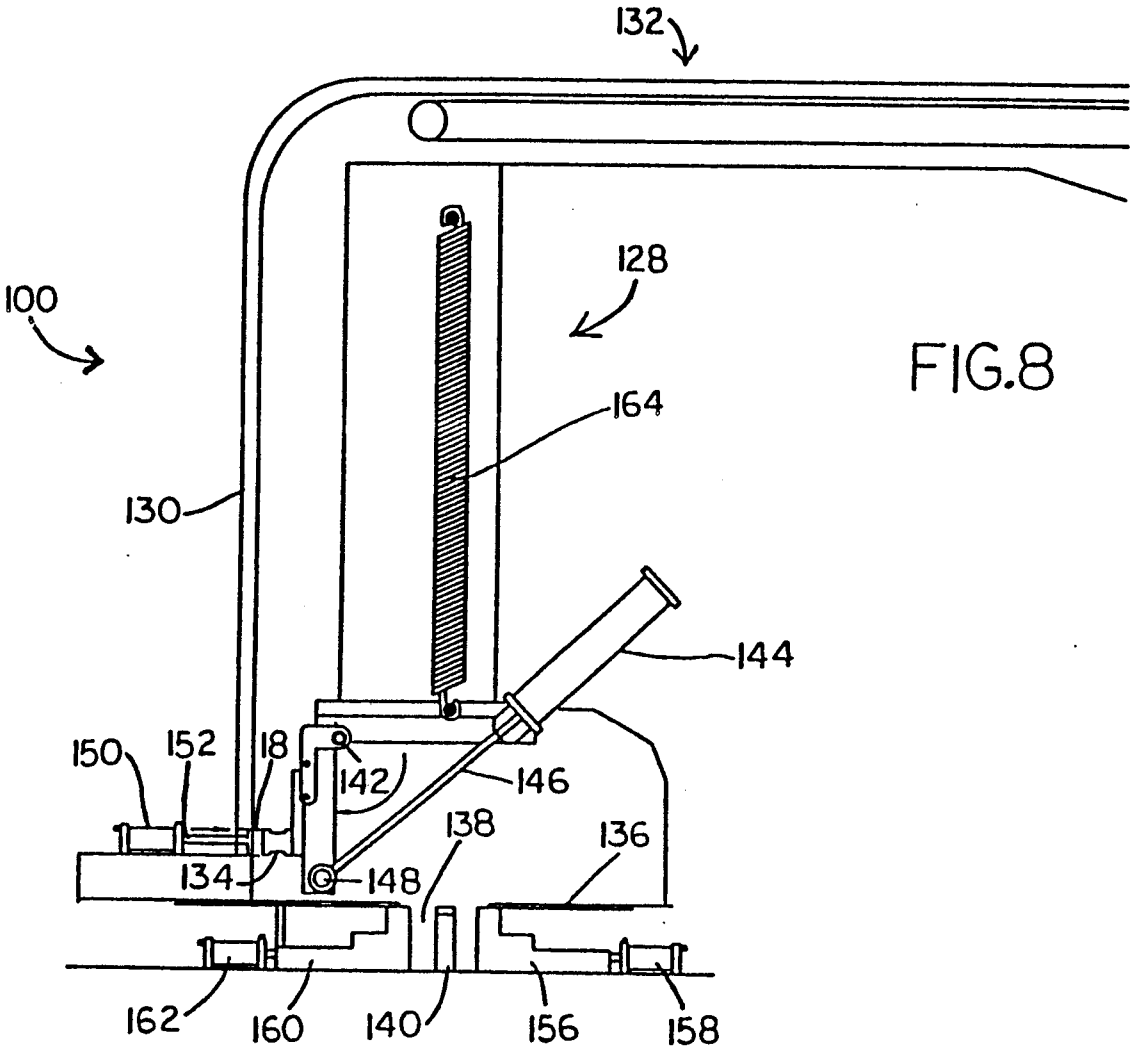
FIG. 8 is a side elevational view of the channel placer in the die extended position.
Figure 9:
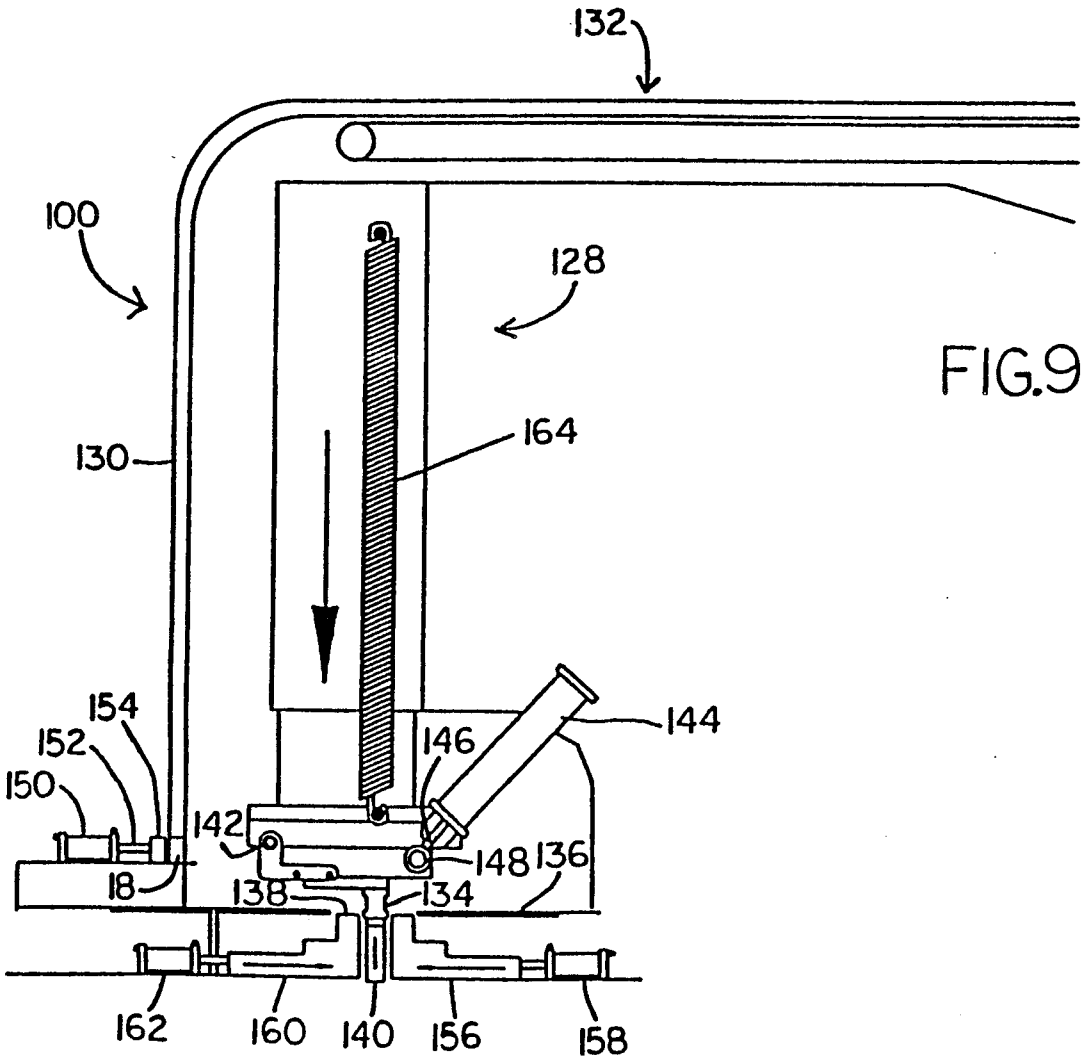
FIG. 9 is a schematic illustration similar to FIG. 8 illustrating a channel placer in the channel positioning mode.
Figure 10:
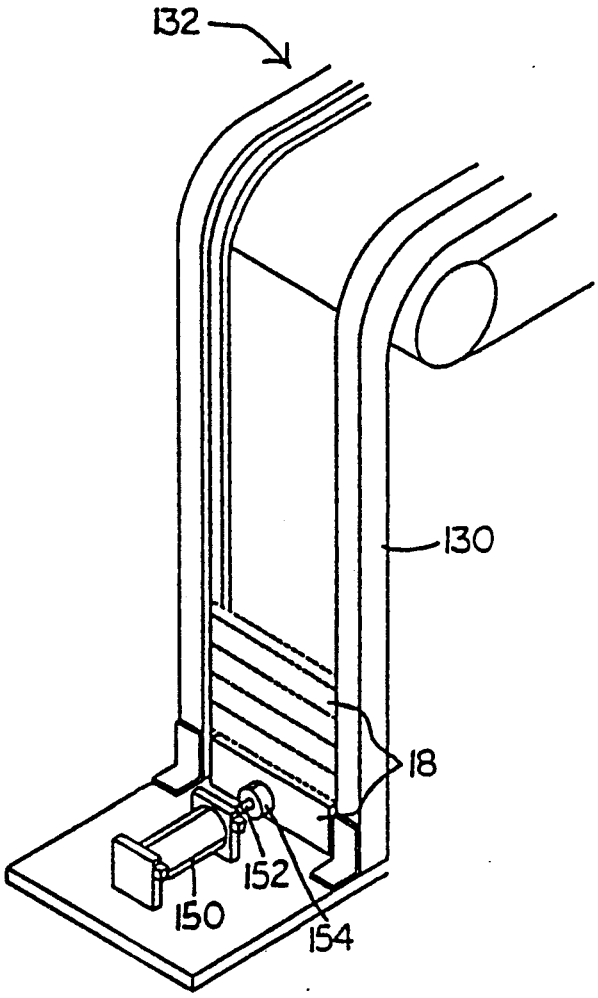
FIG. 10 is a perspective view of a channel feeder used with the assembly of the present invention.

Once the channel 18 is placed onto the channel die 134, the feed rod 152 is retracted and the air cylinder 144 is actuated to pivot the channel die 134 to the original position illustrated in FIG. 7. The channel die 134 is then moved downwardly to press the channel 18 onto the adhesive 20 on the cover case back or joint 16 and against the spring loaded backbone plate (FIG. 9). The pressure applied by the channel die 134 secures the bottom 22 of the channel 18 to the adhesive 20 on the cover case back or joint 16. At the same time, a right side clamp 156 is actuated by a right side clamp cylinder 158 moving the clamp 156 from a standby position illustrated in FIG. 7 to a clamping position illustrated in FIG. 9. Similarly, a left side clamp 160 is actuated by a left side clamp air cylinder 162 from a standby position illustrated in FIG. 7 to a clamping position illustrated in FIG. 9. In the clamping position illustrated in FIG. 9, portions of the cover case back or joint 16 are pressed against the sides 24 of the channel 18. Since the adhesive 20 has been deposited on this portion of the cover case back or joint 16, this clamping action secures the cover case back or joint 16 to the sides 24 of the channel 18. Once this securement has been completed, the right side clamp 156 and the left side clamp 160 are retracted while a spring 164 retracts the channel die 134 to its standby position illustrated in FIG. 7.

Thereafter, a third set of pushers 166 are actuated by the drive rotor assembly 110 to move the cover case 10 with a channel 18 out of the channel placer 128 and onto a conveyor 168. The conveyor 168 may move the cover case 10 to a storage hopper or to another station at which the end sheet 21 is secured by adhesive to inside of the front cover 12 and the inside of the back cover 14 of the cover case 10. Once the end sheet 21 is secured, it is sliced above the channel 18 and the cover case 10 is ready for binding a set of pages 28.

We claim:

1. An apparatus for assembling a cover case and a channel for binding pages in said cover case, comprising:

a hopper for holding a plurality of cover cases, said hopper including an inlet for loading cover cases in said hopper and an outlet for removing cover cases from said hopper;

an adhesive applicator adjacent said hopper;

a moving assembly including a pusher for moving said cover cases from said hopper through said outlet to said adhesive applicator;

said adhesive applicator including an adhesive dispenser for dispensing adhesive onto at least a portion of each of said cover cases;

a cartridge adjacent said adhesive applicator for holding a plurality of channels;

a channel applicator adjacent said cartridge wherein said channel applicator further includes a first side clamp and a second side clamp and an activator for clamping said first side clamp and said second side clamp on a portion of said cover case around said channel;

a first conveyor extending from said adhesive applicator to said channel applicator for moving said cover cases from said adhesive applicator to said channel applicator; and an actuator coupled to said channel applicator for actuating said channel applicator to remove a channel from said cartridge and apply said channel onto said adhesive on said cover case.

2. The apparatus for assembling a cover case and a channel set forth in claim 1 further comprising a second conveyor adjacent said channel applicator for conveying said cover cases with said channel from said channel applicator.

3. The apparatus for assembling a cover case and a channel set forth in claim 2 further comprising a third conveyor interconnecting said cartridge with a source of channels to convey channels from said source to said cartridge.

4. The apparatus for assembling a cover case and a channel set forth in claim 1 wherein said adhesive dispensed by said adhesive dispenser is hot melt adhesive.

5. The apparatus for assembling a cover case and a channel set forth in claim 1 wherein said plurality of channels held by sad cartridge are formed of deformable metal.

6. The apparatus for assembling a cover case and a channel set forth in claim 1 further comprising a sensor in said adhesive applicator for sensing the presence of a cover case and activating said adhesive dispenser.

7. A process for assembling a cover case and a channel page binder, comprising the steps of:

loading a plurality of cover cases in a hopper;

removing a cover case from said hopper;

applying adhesive to at least a first portion of said cover case;

moving said cover case into a channel placer;

removing a channel having a bottom and sides from a channel cartridge;

pressing said channel onto the first portion of said cover case on which adhesive has been applied, and simultaneously;

pressing the cover case against said sides of said channel; and driving said cover case and said channel out of said channel placer.

8. The process for assembling a cover case and a channel page binder claimed in claim 7 wherein said step of pressing said channel onto the first portion of said cover case on which adhesive has been applied further comprises the step of pressing said cover case on a plate at a location under said channel.

9. The process for assembling a cover case and a channel page binder claimed in claim 7 further comprising the steps of applying adhesive to an end sheet, securing said end sheet to a second portion of the cover case; and cutting said end sheet adjacent said channel.

10. An assembly for placing a channel page binder on a cover case, comprising:

a channel die pivotally mounted for movement from a first, standby position to a second position for picking up a channel;

a channel binder feeder for feeding individual channels to said channel die at said second position of said channel die;

a pressing assembly connected to said channel die actuable to press said channel die with a channel against a back of a cover case; and a backbone plate positioned below said channel die and under a cover case in position for placement of a channel binder.

11. The assembly for placing a channel page binder on a cover case set forth in claim 10 further comprising a first side clamp and a second side clamp located below said channel die, ad a clamping member for clamping said first side clamp and said second side clamp on a cover case against said channel die.

12. The assembly for placing a channel page binder on a cover set forth in claim 10 further comprising a conveyor coupled to said channel binder feeder for delivering channels to said channel binder feeder.

13. A process for assembling a cover case and a channel page binder, comprising the steps of:

applying adhesive to a back of a cover case;

pressing a channel page binder on said adhesive;

securing an end sheet over an inside surface of said cover case and over said channel page binder, and slitting said end sheet along said channel page binder to form a first edge and a second edge of said end sheet with said first edge and said second edge extending over said channel page binder.

* * * * *